US009605582B1

(12) United States Patent
Lee

(10) Patent No.: US 9,605,582 B1
(45) Date of Patent: Mar. 28, 2017

(54) EXHAUST PIPE MOUNTING UNIT FOR VEHICLE

(71) Applicant: Hyundai Motor Company, Seoul (KR)

(72) Inventor: SangHo Lee, Gyeongsangbuk-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/944,850

(22) Filed: Nov. 18, 2015

(30) Foreign Application Priority Data

Sep. 15, 2015 (KR) ..... 10-2015-0130421

(51) Int. Cl.
*F16M 13/00* (2006.01)
*F01N 13/18* (2010.01)

(52) U.S. Cl.
CPC ..... *F01N 13/1822* (2013.01)

(58) Field of Classification Search
USPC ..... 248/58, 60, 610, 613, 560, 562
See application file for complete search history.

(56) References Cited

U.S. PATENT DOCUMENTS 6,364,266 B1 * 4/2002 Garvin ..... H02G 3/26 248/303
6,402,119 B1 * 6/2002 Miska ..... F01N 13/1822 248/58
6,622,975 B2 * 9/2003 Steinmaier ..... B60K 13/04 248/60
7,575,216 B2 * 8/2009 Zimmermann ..... B60K 13/04 248/60
8,322,680 B2 * 12/2012 Park ..... B60K 13/04 180/309
9,403,430 B2 * 8/2016 Edo ..... F16L 55/0335
2003/0173489 A1 * 9/2003 Kakimoto ..... F01N 13/1822 248/610
2008/0191117 A1 * 8/2008 Steinmaier ..... F01N 13/1822 248/610
2009/0001242 A1 * 1/2009 Endo ..... B60K 13/04 248/610
2009/0020678 A1 * 1/2009 Miyata ..... B60K 13/04 248/610

FOREIGN PATENT DOCUMENTS

JP 2002-264667 A 9/2002
KR 20-1998-0051801 A 10/1998
(Continued)

*Primary Examiner* — Steven Marsh
(74) *Attorney, Agent, or Firm* — Mintz Levin Cohn Ferris Glovsky and Popeo, P.C.; Peter F. Corless

(57) ABSTRACT

An exhaust pipe mounting unit for a vehicle is provided. The exhaust pipe mounting unit includes a main body that has an operation aperture formed at the center thereof and a connection aperture that is formed at a first side in a length direction of the main body to couple a connection load of a bracket mounted in a lower portion of a vehicle body. A mounting aperture is formed at a second side in a length direction of the main body to connect a hanger rod disposed in an exhaust pipe. A chamber is formed in a lower portion of the interior of the main body to be connected to an internal circumferential surface of the mounting aperture and a lubricant is filled therein. Further a piston within the chamber selectively supplies a lubricant filled in the chamber to an internal circumferential surface of the mounting aperture, upon translation of the exhaust pipe.

9 Claims, 5 Drawing Sheets

(56) References Cited

FOREIGN PATENT DOCUMENTS

| | | | |
|---|---|---|---|
| KR | 20-1999-0031480 | A | 7/1999 |
| KR | 10-2006-0013935 | | 2/2006 |
| KR | 10-2007-0034286 | A | 3/2007 |
| KR | 10-2007-0045515 | | 5/2007 |
| KR | 10-2008-0011745 | | 2/2008 |

* cited by examiner (S1)

(S2)

EXHAUST PIPE MOUNTING UNIT FOR VEHICLE

CROSS-REFERENCE TO RELATED APPLICATION

This application claims priority to and the benefit of Korean Patent Application No. 10-2015-0130421 filed in the Korean Intellectual Property Office on Sep. 15, 2015, the entire contents of which are incorporated herein by reference.

BACKGROUND (a) Field of the Invention

The present invention relates to an exhaust pipe mounting unit for a vehicle and more particularly, to an exhaust pipe mounting unit for a vehicle that connects an exhaust pipe to a vehicle body and that prevents contact noise from occurring upon translation of the exhaust Pipe.

(b) Description of the Related Art

Generally, exhaust gas in an engine of a vehicle after combustion is discharged to the air through an exhaust assembly. For example, the exhaust assembly includes a plurality of exhaust pipes that are connected to an exhaust manifold of the engine and that are connected from a lower portion of a vehicle body to the rear side of the vehicle. Further, a catalyst converter, a center muffler, and a main muffler are disposed between the exhaust pipes.

The catalyst converter is disposed on the engine side and is connected to the exhaust pipe based on the center of a lower portion of the vehicle body. The catalyst converter converts harmful gas in an exhaust gas to a harmless gas through an oxidation reduction reaction. The center muffler is disposed toward the rear side of the vehicle based on the center of a lower portion of the vehicle body and is connected to the catalyst converter via the exhaust pipe. The main muffler is connected to the center muffler and the muffler discharges an exhaust gas to the exterior through the exhaust pipe and reduces noise that occurs when discharging an exhaust gas. In an exhaust assembly having such a configuration, the exhaust pipe is connected to a vehicle body via a hanger rubber and is fixed to a lower portion of the vehicle body.

A conventional hanger rubber is made of a rubber material. A connection load of a bracket mounted in the vehicle body is connected to one end portion of such a hanger rubber. In particular, a hanger rod is disposed in the exhaust pipe and is connected to the other end portion of the hanger rubber. However, as described above, in the conventional hanger rubber, at a contact surface in which the hanger rod is mounted, contact noise occurs when a vibration occurs in the exhaust pipe. Further, the durability of the hanger rubber of a rubber material deteriorates due to frequent friction with the hanger rod. Contact noise is simultaneously transferred to the vehicle body, which compromises the comfort of the vehicle.

The above information disclosed in this section is merely for enhancement of understanding of the background of the invention and therefore it may contain information that does not form the prior art that is already known in this country to a person of ordinary skill in the art.

SUMMARY

The present invention provides an exhaust pipe mounting unit for a vehicle capable of more stably coupling an exhaust pipe to a vehicle body and reduces the occurrence of contact noise upon translation of the exhaust pipe.

In one aspect, an exemplary embodiment of the present invention provides an exhaust pipe mounting unit for a vehicle that may include a main body having an operation aperture that may be formed at the center thereof, at least one connection aperture that may be formed at one side in a length direction of the main body to couple a connection load of a bracket mounted in a lower portion of a vehicle body and a mounting aperture formed at the other side in a length direction of the main body to couple a hanger rod provided in an exhaust pipe. Further a chamber may be formed in a lower portion of the interior of the main body to be coupled to an internal circumferential surface of the mounting aperture and a lubricant may be filled therein. A piston may be disposed within the interior of the chamber to selectively supply a lubricant filled in the chamber by the hanger rod to an internal circumferential surface of the mounting aperture, upon translation of an exhaust.

At the interior of the main body, a connection flow channel may be included having a first end that communicates with the mounting aperture and a second end communicates with the chamber and may be formed at both sides of a width direction of the main body. The piston may be disposed within the chamber to correspond to the mounting aperture and may perform a reciprocating movement in a width direction of the main body. The lubricant may be selectively coated (e.g., disposed on) to an internal circumferential surface of the mounting aperture through the connection flow channel based on a width direction movement of the piston.

The connection flow channel may include a first connection flow channel formed at a first side of a width direction within the main body; and a second connection flow channel formed at a second side of a width direction thereof within the main body. Further, within the main body, at the outer circumferential surfaces of both sides of a width direction, the chamber and a filling flow channel may be formed and may be connected therein. One end of the filling flow channel may be in fluid communication with the chamber, and a second end thereof may be in fluid communication with an outer circumferential surface of the main body. The main body may be made of a rubber material. The operation aperture may be disposed separately between the connection aperture and the mounting aperture.

As described above, by an exhaust pipe mounting unit for a vehicle according to an exemplary embodiment of the present invention, an exhaust pipe may be more stably connected to a vehicle body. When the exhaust pipe translates, by enabling a lubricant to be supplied between a hanger rod of the exhaust pipe, contact noise may be reduced. Further, by the reduction of the contact noise from occurring between the hanger rod of the exhaust pipe and an exhaust pipe mounting unit, ride comfort of a vehicle may be improved. In addition, by reducing (e g, minimizing) a friction from occurring between the exhaust pipe mounting unit and the hanger rod, durability of the exhaust pipe mounting unit may be improved.

BRIEF DESCRIPTION OF THE DRAWINGS

The above and other objects, features and advantages of the present invention will be more clearly understood from the following detailed description when taken in conjunction with the accompanying drawings, in which.

DESCRIPTION OF SYMBOLS

Figure 1:
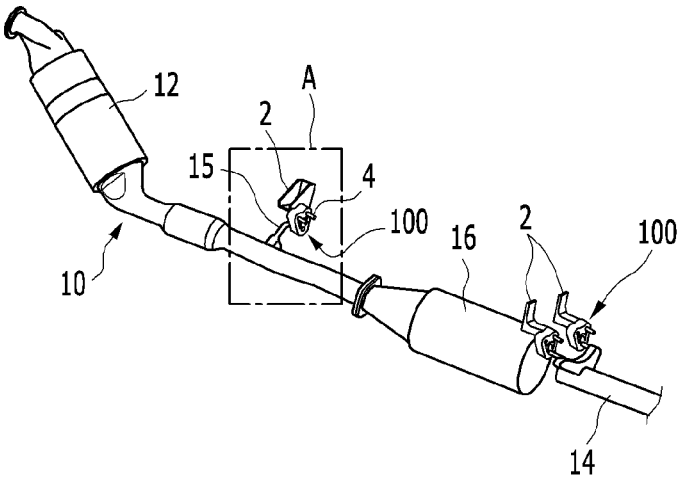
FIG. 1 is an exemplary schematic diagram illustrating an exhaust pipe mounting unit for a vehicle according to an exemplary embodiment of the present invention.

100: exhaust pipe mounting unit
110: main body
112: operation aperture
120: connection aperture
130: mounting aperture
140: chamber
142: connection flow channel
142*a*: first connection flow channel
142*b*: second connection flow channel
144: filling flow channel

DETAILED DESCRIPTION

An exemplary embodiment of the present invention will hereinafter be described in detail with reference to the accompanying drawings.

An exemplary embodiment described in this specification and a configuration shown in the drawing is merely an exemplary embodiment of the present invention and do not represent an entire technical idea of the present invention and thus it should be understood that various equivalents and exemplary variations that can replace the exemplary embodiment may exist at an application time point of the present invention. On the contrary, the invention is intended to cover not only the exemplary embodiments, but also various alternatives, modifications, equivalents and other embodiments, which may be included within the spirit and scope of the invention as defined by the appended claims.

The drawings and description are to be regarded as illustrative in nature and not restrictive. Like reference numerals designate like elements throughout the specification. Further, in the drawings, a size and thickness of each element are randomly represented for better understanding and ease of description and the present invention is not limited thereto and the thickness of several portions and areas are exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween. In addition, the terms " . . . unit", " . . . means", " . . . unit", and " . . . member" described in the specification mean units for processing at least one function and operation.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

Figure 2:
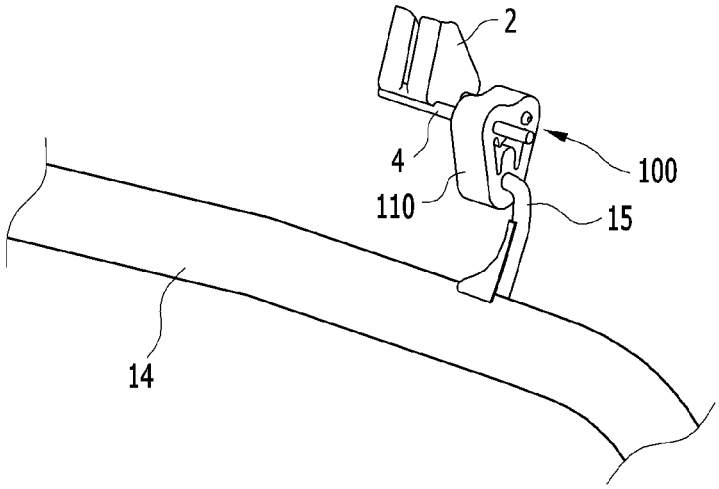
FIG. 2 is an exemplary enlarged view of a portion A of FIG. 1 according to an exemplary embodiment of the present invention.
Figure 3:
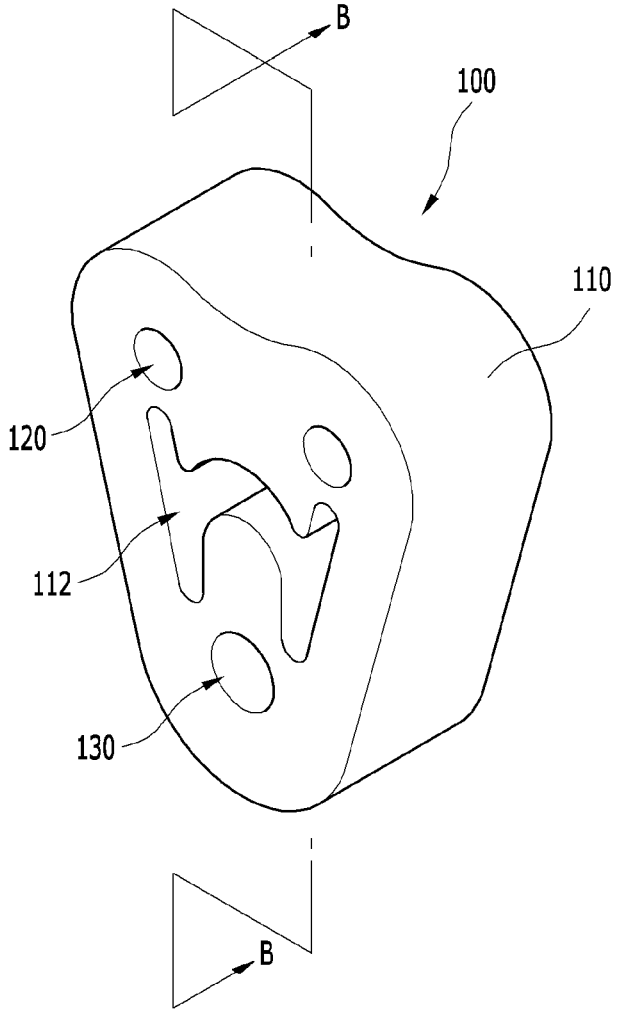
FIG. 3 is an exemplary perspective view illustrating an exhaust pipe mounting unit for a vehicle according to an exemplary embodiment of the present invention.
Figure 4:
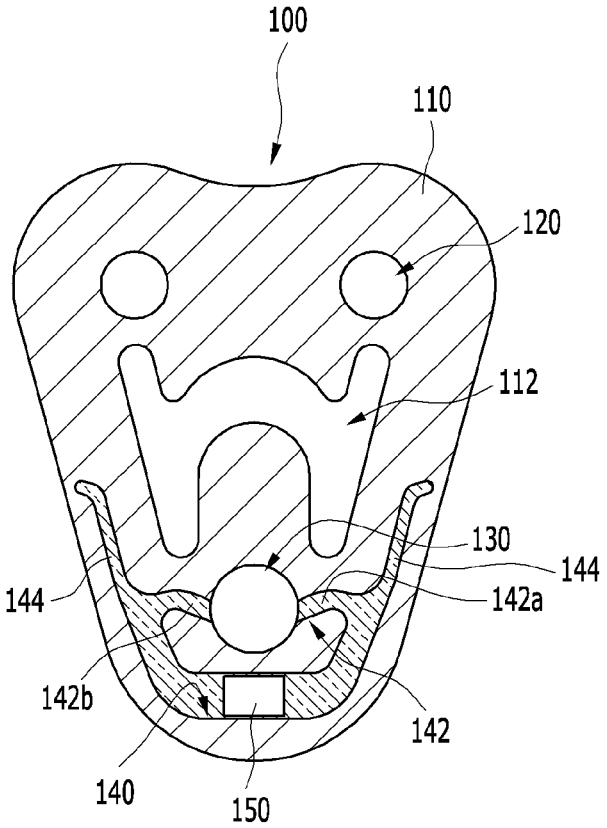
FIG. 4 is an exemplary cross-sectional view illustrating the exhaust pipe mounting unit taken along line B-B of FIG. 3 according to an exemplary embodiment of the present invention.

FIG. 1 is an exemplary schematic diagram illustrating an exhaust pipe mounting unit for a vehicle according to an exemplary embodiment of the present invention. FIG. 2 is an exemplary enlarged view of a portion A of FIG. 1. FIG. 3 is an exemplary perspective view illustrating an exhaust pipe mounting unit for a vehicle according to an exemplary embodiment of the present invention. FIG. 4 is an exemplary cross-sectional view illustrating the exhaust pipe mounting unit taken along line B-B of FIG. 3. An exhaust pipe mounting unit 100 for a vehicle according to an exemplary embodiment of the present invention mounts an exhaust assembly 10 that may include a catalyst converter 12, a center muffler 16, and a main muffler (not shown) connected via an engine (not shown) and an exhaust pipe 14 in a lower portion of a vehicle body (not shown), as shown in FIG. 1. For example, in the lower portion of the vehicle body, a bracket 2 may have a connection load 4 mounted. In the exhaust pipe 14, a hanger rod 15 may be provided.

As shown in FIGS. 2 to 4, an exhaust pipe mounting unit 100 may include a main body 110, a connection aperture 120, a mounting aperture 130, a chamber 140, and a piston 150. At the center of the main body 110, an operation aperture 112 may be formed. A main body 110 may be made of a rubber material. When the exhaust pipe 14 translates, by inducing a change of the main body 110, the operation aperture 112 may absorb an impact load. An operation aperture 112 may be disposed separately between the connection aperture 120 and the mounting aperture 130. For example, to couple the connection load 4 of the bracket 2 mounted in a lower portion of a vehicle body, the connection aperture 120 may be formed at one side in a length direction of the main body 110.

In one end portion toward a lower portion of the vehicle body, two connection apertures 120 may be separately formed. In other words, to connect the hanger rod 15 disposed in the exhaust pipe 14, the mounting aperture 130 may be formed at the adjacent side in a length direction of the main body 110. The hanger rod 15 may be inserted into a mounting aperture 130.

In the exemplary embodiment, the chamber 140 may be formed in a lower portion of the interior of the main body 110 coupled to an internal circumferential surface of the mounting aperture 130 and a lubricant may filled therein. In particular, the interior of the main body 110, may include a connection flow channel 142 having a first end in fluid communication with the mounting aperture 130 and a second end in fluid communication with the chamber 140 may be formed at both sides of a width direction of the main body 110.

The connection flow channel 142 may include a first connection flow channel 142*a* and a second connection flow channel 142*b*. The first connection flow channel 142*a* may be formed at a first side of a width direction within the main body 110. The second connection flow channel 142*b* may be formed at a second side of a width direction within the main body 110. In the exemplary embodiment, within the main body 110, at outer circumferential surfaces of both sides of a width direction, the chamber 140 and a filling flow channel 144, may be formed and connected.

A first end of the filling flow channel 144 may be in fluid communication with the chamber 140, and the second end thereof may be in fluid communication with an outer circumferential surface of the main body 110. In other words, at the interior of the chamber 140, when filling a lubricant (e.g., filling grease), a separate lubricant injection apparatus may inject the lubricant to one end of the filling flow channel 144 that in fluid communication with both sides of an outer circumferential surface of the main body 110. Accordingly, the lubricant may be filled within the interior of the chamber 140 through the filling flow channel 144. The exhaust pipe 14 may translate, to selectively supply a lubricant filled within the chamber 140 by the hanger rod 15 to an internal circumferential surface of the mounting aperture 130. Further, the piston 150 may be disposed within the chamber 140. For example, the piston 150 may be disposed at the center of a width direction of the main body 110 within the chamber 140 to correspond to the mounting aperture 130. The piston 150 may be provided to perform a reciprocating movement in a width direction of the main body 110. Accordingly, the piston 150 may translate (e.g., move) in the same direction as that of the hanger rod 15 based on the movement of the exhaust pipe 14.

The lubricant may be selectively coated at an internal circumferential surface of the mounting aperture 130 through the first connection flow channel 142*a* or the second connection flow channel 142*b* based on a width direction movement of the piston 150. For example, when the hanger rod 15 translates to a side of a width direction of the main body 110, the piston 150 may translate in the same direction as that of the hanger rod 15. Thereafter, a lubricant may be injected into the first connection flow channel 142*a* or the second connection flow channel 142*b* provided in a translation direction of the piston 150 from the chamber 140 and may be disposed (e.g., coated) on an internal circumferential surface of the mounting aperture 130 that contacts with the hanger rod 15.

Figure 5:
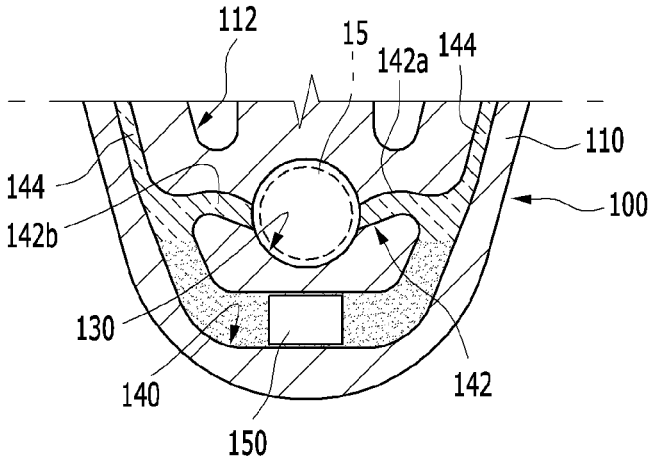
FIG. 5 is an exemplary diagram illustrating an operation state of an exhaust pipe mounting unit for a vehicle according to an exemplary embodiment of the present invention.
Figure 5:
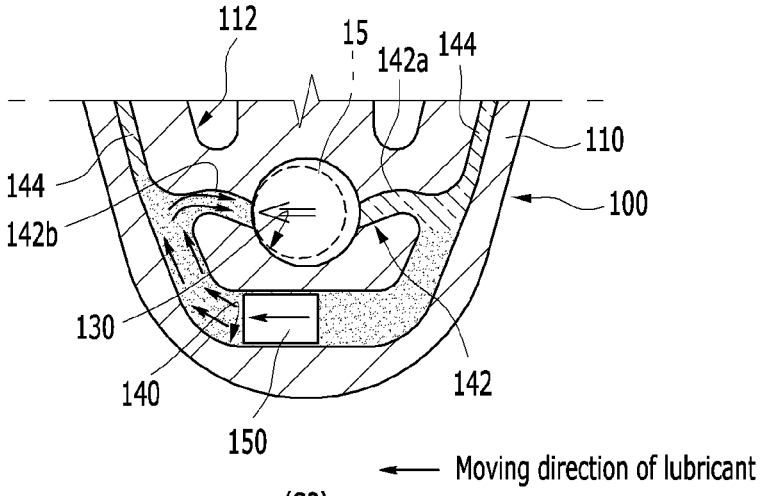

Hereinafter, operation of an exhaust pipe mounting unit for a vehicle according to an exemplary embodiment of the present invention having the above-described configuration will be described in detail. FIG. 5 is an exemplary diagram illustrating an operation state of an exhaust pipe mounting unit for a vehicle according to an exemplary embodiment of the present invention. When the exhaust pipe 14 does not move, (e.g., is stationary) the hanger rod 15 may maintain an initial location that is mounted in the mounting aperture 130, as in FIG. 5 S1. Accordingly, the piston 150 may be disposed (e.g., located) at the center of the interior of the chamber 140, and a lubricant may be filled within the chamber 140 may not be injected into the first and second connection flow channels 142*a* and 142*b*.

Alternatively, as in FIG. 5S2, when the exhaust pipe 14 translates to the left side in the drawing, the hanger rod 15 translates toward the second connection flow channel 142*b* to contact an internal circumferential surface of the mounting aperture 130. Thereafter, the piston 150 translates toward the second connection flow channel 142*b* within the chamber 140 by the hanger rod 15. Accordingly, a lubricant may be injected from the interior of the chamber 140 to the second connection flow channel 142*b* to be disposed (e.g., coated) on an internal circumferential surface of the mounting aperture 130.

The lubricant may be coated through the second connection flow channel 142*b* and may prevent the hanger rod 15 and the mounting aperture 130 from directly contacting to reduce (e.g., minimize) friction. In other words, when the exhaust pipe 14 translates, while the hanger rod 15 directly contacts the mounting aperture 130, the exhaust pipe mounting unit 100 may prevent a contact noise from occurring by friction. Therefore, when applying an exhaust pipe mounting unit 100 for a vehicle according to an exemplary embodiment, the exhaust pipe 14 is more stably connected to a vehicle body, and when the exhaust pipe 14 translates, by enabling a lubricant to be supplied between the hanger rod 15 of the exhaust pipe 14 and the mounting aperture 130, contact noise may be reduced or prevented from occurring. Further, by reducing or preventing contact noise between the hanger rod 15 of the exhaust pipe 14 and the exhaust pipe mounting unit 100, ride comfort of a vehicle may be improved. A reduction of friction between the hanger rod 15 and the mounting aperture 130, may improve the durability of the exhaust pipe mounting unit 100.

While this invention has been described in connection with what is presently considered to be an exemplary embodiment, it is to be understood that the invention is not limited to the disclosed exemplary embodiments, but, on the contrary, is intended to cover various modifications and equivalent arrangements included within the spirit and scope of the appended claims.

What is claimed is:

1. An exhaust pipe mounting unit for a vehicle, comprising:

a main body that includes an operation aperture formed at a center thereof;

at least one connection aperture formed at a first side in a length direction of the main body to connect a connection load of a bracket mounted in a lower portion of a vehicle body to the main body;

a mounting aperture formed at a second side in a length direction of the main body to couple a hanger rod disposed in an exhaust pipe to the exhaust pipe;

a chamber formed in a lower portion of an interior of the main body to be coupled to an internal circumferential surface of the mounting aperture and having a lubricant that is filled therein; and a piston disposed within the chamber to selectively supply a lubricant filled in the chamber by the hanger rod to an internal circumferential surface of the mounting aperture, when the exhaust pipe translates.

2. The exhaust pipe mounting unit of claim 1, wherein at the interior of the main body, a connection flow channel having a first end in fluid communication with the mounting aperture and a second end in fluid communication with the chamber is formed at both sides of a width direction of the main body.

3. The exhaust pipe mounting unit of claim 2, wherein the piston is disposed at the interior of the chamber to correspond to the mounting aperture and performs a reciprocating movement in a width direction of the main body.

4. The exhaust pipe mounting unit of claim 3, wherein the lubricant is selectively applied to an internal circumferential surface of the mounting aperture through the connection flow channel based on a width direction movement of the piston.

5. The exhaust pipe mounting unit of claim 2, wherein the connection flow channel includes:

a first connection flow channel formed at a first side of a width direction at the interior of the main body; and a second connection flow channel formed at a second side of a width direction at the interior of the main body.

6. The exhaust pipe mounting unit of claim 1, wherein in the main body, at outer circumferential surfaces of both sides of a width direction, the chamber and a filling flow channel connected therein are formed.

7. The exhaust pipe mounting unit of claim 6, wherein a first end of the filling flow channel is in fluid communication with the chamber, and a second end of the filling flow channel is in fluid communication with an outer circumferential surface of the main body.

8. The exhaust pipe mounting unit of claim 1, wherein the main body is made of a rubber material.

9. The exhaust pipe mounting unit of claim 1, wherein the operation aperture is disposed separately between the connection aperture and the mounting aperture.

* * * * *